US008194895B2

(12) United States Patent
Akino

(10) Patent No.: US 8,194,895 B2
(45) Date of Patent: Jun. 5, 2012

(54) CONDENSER MICROPHONE

(75) Inventor: Hiroshi Akino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 213 days.

(21) Appl. No.: 12/801,877

(22) Filed: Jun. 30, 2010

(65) Prior Publication Data

US 2011/0007925 A1 Jan. 13, 2011

(30) Foreign Application Priority Data

Jul. 9, 2009 (JP) ..... 2009-162343

(51) Int. Cl.
*H04R 25/00* (2006.01)

(52) U.S. Cl. ..... 381/174; 381/111; 381/113; 381/355

(58) Field of Classification Search ..... 381/174, 381/111, 113, 355
See application file for complete search history.

(56) References Cited

U.S. PATENT DOCUMENTS 4,448,837 A * 5/1984 Ikeda et al. ..... 428/215
4,837,377 A * 6/1989 Zimmerman et al. ..... 423/448
6,856,689 B2 * 2/2005 Sudo et al. ..... 381/355
7,558,397 B2 * 7/2009 Akino ..... 381/369
7,602,931 B2 * 10/2009 Akino et al. ..... 381/355
7,630,506 B2 * 12/2009 Akino ..... 381/174
7,664,286 B2 * 2/2010 Akino ..... 381/361
7,720,239 B2 * 5/2010 Akino ..... 381/174
7,801,316 B2 * 9/2010 Akino ..... 381/174
7,804,968 B2 * 9/2010 Akino ..... 381/111
8,031,899 B2 * 10/2011 Akino ..... 381/361
8,085,965 B2 * 12/2011 Akino ..... 381/368
8,103,038 B2 * 1/2012 Akino et al. ..... 381/355
2001/0010726 A1 * 8/2001 Fujimoto et al. ..... 381/368
2005/0031150 A1 * 2/2005 Collins ..... 381/355
2005/0163336 A1 * 7/2005 Hiramoto et al. ..... 381/369
2005/0259835 A1 * 11/2005 Akino ..... 381/111
2005/0259842 A1 * 11/2005 Akino et al. ..... 381/369
2006/0088169 A1 * 4/2006 Akino ..... 381/26
2006/0109990 A1 * 5/2006 Akino ..... 381/174
2006/0115106 A1 * 6/2006 Akino ..... 381/369
2006/0120544 A1 * 6/2006 Akino ..... 381/174
2006/0133626 A1 * 6/2006 Akino ..... 381/174
(Continued)

*Primary Examiner* — David S. Warren
(74) *Attorney, Agent, or Firm* — Manabu Kanesaka

(57) ABSTRACT

There is provided a condenser microphone in which electromagnetic shielding in the connecting part of a microphone capsule and a microphone main body is made more reliable. In the condenser microphone including a microphone capsule 10 and a microphone main body 20, the microphone capsule 10 being configured so that an electrostatic acoustic-electric converter is accommodated in a metallic capsule housing 11, and an extraction electrode 15 of a backplate 142 is disposed in substantially the central portion of a connection-side opening part 120, and the microphone main body 20 being configured so that a circuit board 22 is disposed at a predetermined depth position in a connection-side opening part 210 of a metallic microphone housing 21 to which the capsule housing 11 is detachably connected, and a field effect transistor 23 and a conductive contacting means for connecting the gate of the field effect transistor 23 to the extraction electrode 15 are disposed; and configured so that the extraction electrode 15 is connected to the gate of the field effect transistor 23 via the conductive contacting means with the connection of the capsule housing 11 to the microphone housing 21, as the conductive contacting means, a conductive elastic material 31 such as a conductive resin foam or a conductive cloth is used, and a ferrite material 32 is disposed on the circuit board 22 so as to surround the conductive elastic material 31.

3 Claims, 1 Drawing Sheet

U.S. PATENT DOCUMENTS

2006/0154500 A1* 7/2006 Igarashi et al. ..... 439/86
2006/0159294 A1* 7/2006 Akino ..... 381/174
2007/0036361 A1* 2/2007 Akino ..... 381/26
2007/0242841 A1* 10/2007 Akino ..... 381/174
2008/0232629 A1* 9/2008 Akino et al. ..... 381/355
2009/0232336 A1* 9/2009 Pahl ..... 381/175
2010/0127724 A1* 5/2010 Naoi et al. ..... 324/757
2010/0220880 A1* 9/2010 Weidner ..... 381/317
2010/0295646 A1* 11/2010 Harrison et al. ..... 336/192
2011/0007925 A1* 1/2011 Akino ..... 381/369
2011/0013800 A1* 1/2011 Akino ..... 381/361
2011/0110542 A1* 5/2011 Masuda ..... 381/190
2011/0182456 A1* 7/2011 Akino ..... 381/361
2011/0255720 A1* 10/2011 Kao et al. ..... 381/191

* cited by examiner

CONDENSER MICROPHONE

CROSS-REFERENCE TO RELATED APPLICATION

The present application is based on, and claims priority from, Japanese Application Serial Number JP2009-162343, filed Jul. 9, 2009, the disclosure of which is hereby incorporated by reference herein in its entirety.

TECHNICAL FIELD

The present invention relates to a condenser microphone in which a microphone capsule is exchangeable with respect to a microphone main body. More particularly, it relates to an electromagnetic shielding technique in a connecting part of the condenser microphone.

BACKGROUND ART

For the condenser microphone, an electrostatic acoustic-electric converter provided in a microphone unit has a very high impedance. Therefore, the microphone incorporates an electronic circuit including an impedance converter. As the impedance converter, a field effect transistor (FET) has usually been used.

Therefore, when a high-frequency current caused by external electromagnetic waves (especially, electromagnetic waves emitted from a cellular phone) is applied to the electronic circuit, the current is detected by the FET, and noise of an audible frequency may be generated.

This problem is solved by reliable shielding of a microphone housing. However, for the condenser microphone of a type such that a microphone capsule is exchangeable with respect to a microphone main body, since electrical connection is made in a mechanically connected portion, the high-frequency current is liable to intrude into the microphone housing through the connecting part.

The intrusion of the high-frequency current into the FET can be prevented by ferrite beads mounted at the gate of FET.

However, since the gate part of FET has a high impedance, vibrating noise may be generated if the ferrite beads vibrate mechanically, and leak noise may be generated if the electrical insulation is insufficient.

As a solution of this vibrating noise problem, the present applicant has proposed, in Japanese Patent Application Publication No. 2007-28027, a technique in which the extraction electrode of a backplate on the microphone capsule side and the gate of the FET on the microphone main body side are electrically connected to each other via a conductive elastic material such as a conductive cloth.

According to this technique, the conductive elastic material is in planar contact with the extraction electrode of backplate and the gate of FET with a large area. Therefore, the contact resistance value is reduced accordingly, and a stable connecting state can be formed, so that the vibrating noise can be reduced effectively.

Accordingly, an object of the present invention is to provide a condenser microphone configured so that a microphone capsule is exchangeable with respect to a microphone main body, in which electromagnetic shielding is made more reliable by providing a conductive elastic material such as a conductive cloth and a ferrite material in the connecting part of the microphone capsule and the microphone main body.

SUMMARY OF THE INVENTION

To achieve the above object, the present invention provides a condenser microphone including a microphone capsule and a microphone main body, the microphone capsule being configured so that an acoustic-electric converter including a diaphragm and a backplate is accommodated in a metallic capsule housing provided with an acoustic terminal on one end surface side and an opening part on the other end surface side, and an extraction electrode of the backplate is disposed in substantially the central portion of the opening part, and the microphone main body being configured so that a circuit board is disposed at a predetermined depth position in a connection-side opening part of a microphone housing formed of a metallic cylindrical body to which the capsule housing is detachably connected, and a field effect transistor (FET) and a conductive contacting means for connecting the gate of the FET to the extraction electrode are disposed; and configured so that the extraction electrode is connected to the gate of the FET via the conductive contacting means with the connection of the capsule housing to the microphone housing, wherein the conductive contacting means is formed of a conductive elastic material such as a conductive resin foam or a conductive cloth, and a ferrite material is disposed on the circuit board so as to surround the conductive elastic material.

Also, to reduce vibrating noise, it is preferable that the ferrite material be fixed on the circuit board via an electrical insulating holding ring.

According to the present invention, since the extraction electrode of the backplate on the microphone side is in planar contact with the gate of the FET on the microphone main body side with a large area via the conductive elastic material such as a conductive cloth, the contact resistance value is reduced accordingly, and a stable connecting state can be formed. Also, since the ferrite material is disposed so as to surround the conductive elastic material, a high-frequency current caused by external electromagnetic waves can be prevented from flowing to the gate of the FET.

According to a preferred mode of the present invention, the ferrite material is formed in a cylindrical shape as ferrite beads, and the conductive elastic material is accommodated in the ferrite beads.

Also, since the ferrite material is fixed, as the cylindrical ferrite beads, on the circuit board via the electrical insulating holding ring, vibrating noise caused by mechanical vibrations of the ferrite beads and leak noise caused by the contact with the gate of the FET can be prevented from being generated.

DETAILED DESCRIPTION

An embodiment of the present invention will now be described with reference to FIGS. 1 to 3. The present invention is not limited to this embodiment.

Figure 1:
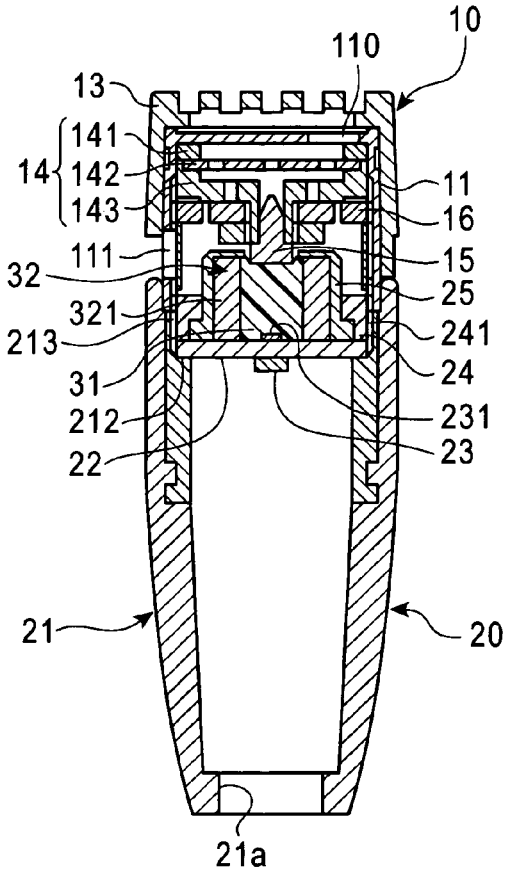
FIG. 1 is a sectional view showing an assembled state of a condenser microphone in accordance with the present invention.
Figure 2:
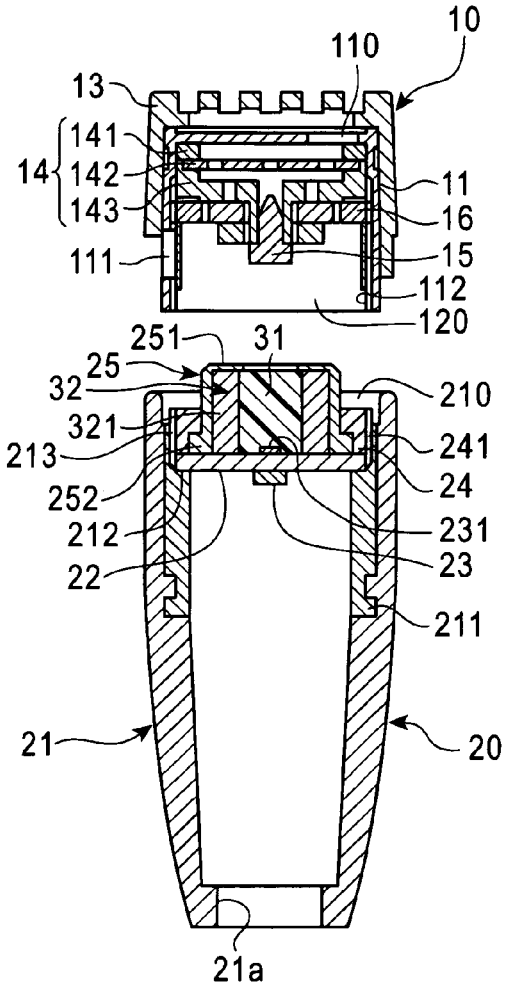
FIG. 2 is a sectional view showing a state in which a microphone capsule and a microphone main body, which are included in a condenser microphone in accordance with the present invention, are separated from each other.
Figure 3:
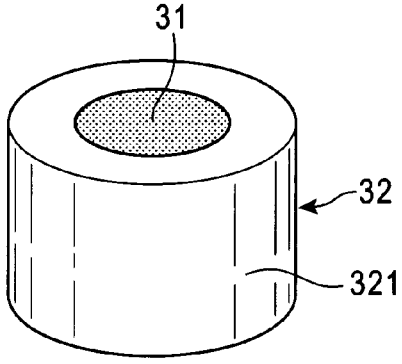
FIG. 3 is a perspective view of ferrite beads and a conductive elastic material.

Referring to FIGS. 1 and 2, a condenser microphone in accordance with the present invention includes a microphone capsule 10 and a microphone main body 20, and is configured so that the microphone capsule 10 can be exchanged according to a desired directionality.

The microphone capsule 10 is provided with a capsule housing 11 formed of a metallic cylindrical body. On one end surface (the upper end surface in FIGS. 1 and 2) side of the capsule housing 11, a front acoustic terminal 110 is provided, and the other end surface (the lower end surface in FIGS. 1 and 2) side thereof serves as an opening part 120.

In this example, since the microphone capsule 10 is unidirectional, a rear acoustic terminal 111 is provided on the side surface of the capsule housing 11. Also, on one end surface side of the capsule housing 11, a resonator 13 is coveringly provided.

In the capsule housing 11, an electrostatic acoustic-electric converter 14 is accommodated. The acoustic-electric converter 14 is assembled by opposedly displacing a diaphragm (not shown) stretchedly provided on a diaphragm ring 141 and a backplate 142 supported on an insulating seat 143 via a separator ring (not shown).

In substantially the center of the insulating seat 143, an extraction electrode 15 that is electrically connected to the backplate 142 via a wiring material (not shown) is provided. The extraction electrode 15 is a rod-like electrode, and is disposed in substantially the center in the opening part 120 of the capsule housing 11.

On the inner surface on the opening part 120 side of the capsule housing 11, there is formed internal threads 112 used for fixing the acoustic-electric converter 14 and for connecting with the microphone main body 20. That is, the acoustic-electric converter 14 is fixed in the capsule housing 11 by a lock ring 16 threadedly engaged with the internal threads 112.

The microphone main body 20, which is also called a power module section or a sound signal output section, is provided with a cylindrical microphone housing 21 formed of a metallic material such as a brass alloy. Through an opening part 21*a* on one end side (the lower end side in FIGS. 1 and 2) of the microphone main body 20, a microphone cable (not shown) is brought into the microphone housing 21.

In an opening part 210 on the other side (the lower end side in FIGS. 1 and 2, the side on which the microphone housing 21 is connected to the capsule housing 11) of the microphone housing 21, a circuit board 22, on which a field effect transistor (FET) 23 serving as an impedance converter is mounted, is disposed.

In this embodiment, the microphone housing 21 has an internal cylinder 211 formed of a metallic material fitted in the connection-side opening part 210. The internal cylinder 211 may be integral with the microphone housing 21. In the internal cylinder 211, a step part 212 for supporting the circuit board 22 is formed in a ring shape.

Thereby, at a predetermined depth position in the connection-side opening part 210, the circuit board 22 is supported by the step part 212 so as to close the interior of the internal cylinder 211.

The circuit board 22 is disposed in the internal cylinder 211 in such manner that the mounting surface of the FET 23 is directed downward. On the opposite surface (the upper surface in FIGS. 1 and 2) side of the circuit board 22, a gate extraction electrode 231 connected to the gate of the FET 23 via a through hole (not shown) is formed of a copper foil or the like.

Although not shown, at the peripheral edge of the circuit board 22, there is formed a ground pattern that is in contact with the step part 212 so as to be electrically connected to the internal cylinder 211 and the microphone housing 21. The microphone cable brought into the microphone housing 21 through the opening part 21*a* is a two-core shield covered cable containing a power line and a signal line. The power line is connected to the drain of the FET 23, the signal line is connected to the source thereof, and the shield covered cable is connected to the ground pattern.

Above the gate extraction electrode 231 on the upper surface of the circuit board 22, there is provided a conductive contacting means for connecting the gate extraction electrode 231 and the extraction electrode 15 of the backplate 142 to each other.

In the present invention, the conductive contacting means is formed of a conductive elastic material 31 having both of elasticity and conductivity. As the conductive contacting means, CONDUCTIVE FOMA part number Sui-78-5020T (Refer to Japanese Patent No. 3306665) formed of a resin foam or a textile of metallic fiber called a conductive cloth may be used.

On the upper surface of the circuit board 22, a ferrite material 32 is disposed so as to surround the conductive elastic material 31. It is preferable that the ferrite material 32 be ferrite beads 321, and be used in the state in which the conductive elastic material 31 is packed into a hole therein as shown in FIG. 3.

Next, the configuration of the connecting means is explained. Above the step part 212 of the internal cylinder 211, an internal thread cylinder 213 is formed integrally. In the internal thread cylinder 213, a metallic coupler ring 24 having external threads 241 is threadedly mounted.

In this case, the coupler ring 24 is configured so that the lower half of the external threads 241 is threadedly engaged with the internal thread cylinder 213, and the internal threads 112 of the capsule housing 11 is threadedly engaged with the remaining upper half of external threads 241.

Thereby, as shown in FIG. 1, the capsule housing 11 and the microphone housing 21 are connected to each other mechanically and electrically via the coupler ring 24, and function as a shielded casing. Also, the extraction electrode 15 of the backplate 142 and the gate extraction electrode 231 of the FET 23 are connected to each other electrically via the conductive elastic material 31.

Ferrite beads 321 (the ferrite material 32) are preferably fixed on the circuit board 22 by an electrical insulating holding ring 25.

In this embodiment, the holding ring 25 is a cylindrical body formed of a synthetic resin such as polycarbonate, the cylindrical body including a pressing plate 251, which is in contact with the upper surface of the ferrite beads 321, at the upper edge, and a flange 252, which has an enlarged diameter, at the lower edge. Since the flange 252 is held between the coupler ring 24 and the circuit board 22, the ferrite beads 321 are fixed on the circuit board 22.

As described above, according to the present invention, the extraction electrode 15 of the backplate 142 on the microphone capsule 10 side is in planar contact with the gate of the FET 23 on the microphone main body 20 side with a large area via the conductive elastic material 31 such as a conductive cloth. Therefore, the contact resistance value is reduced accordingly, and a stable connecting state can be formed. Also, since the ferrite material is disposed so as to surround the conductive elastic material 31, a high-frequency current caused by external electromagnetic waves can be prevented from flowing to the gate of the FET 23.

Also, since the ferrite material 32 is formed by the cylindrical ferrite beads 321, and is fixed on the circuit board 22 via the electrical insulating holding ring 25, vibrating noise caused by mechanical vibrations of the ferrite beads 321 and leak noise caused by the contact with the gate of the FET 23 can be prevented from being generated.

The invention claimed is:

1. A condenser microphone comprising a microphone capsule and a microphone main body, the microphone capsule being configured so that an acoustic-electric converter including a diaphragm and a backplate is accommodated in a metallic capsule housing provided with an acoustic terminal on one end surface side and an opening part on the other end surface side, and an extraction electrode of the backplate is disposed in substantially the central portion of the opening part, and the microphone main body being configured so that a circuit board is disposed at a predetermined depth position in a connection-side opening part of a microphone housing formed of a metallic cylindrical body to which the capsule housing is detachably connected, and a field effect transistor and a conductive contacting means for connecting the gate of the field effect transistor to the extraction electrode are disposed; and configured so that the extraction electrode is connected to the gate of the field effect transistor via the conductive contacting means with the connection of the capsule housing to the microphone housing, wherein the conductive contacting means is formed of a conductive elastic material, and a ferrite material is disposed on the circuit board so as to surround the conductive elastic material.

2. The condenser microphone according to claim 1, wherein the ferrite material is formed in a cylindrical shape as ferrite beads, and the conductive elastic material is accommodated in the ferrite beads.

3. The condenser microphone according to claim 1, wherein the ferrite material is fixed on the circuit board via an electrical insulating holding ring.

* * * * *